US005931712A

United States Patent [19]

Hattori et al.

[11] Patent Number: 5,931,712

[45] Date of Patent: Aug. 3, 1999

[54] EXHAUST PROBE ARRANGEMENT FOR SMALL WATERCRAFT ENGINE

[75] Inventors: Toshiyuki Hattori; Ryoichi Nakase, both of Iwata; Masanori Takahashi; Akihiko Hoshiba, both of Hamamatsu, all of Japan

[73] Assignees: Yamaha Hatsudoki Kabushiki Kaisha; Sanshin Kogyo Kabushiki Kaisha, both of Japan

[21] Appl. No.: 08/820,746

[22] Filed: Mar. 19, 1997

[30] Foreign Application Priority Data

Mar. 19, 1996 [JP] Japan ..... 8-063201

[51] Int. Cl.[6] ..... B63H 21/32

[52] U.S. Cl. ..... 440/89; 114/55.5; 60/321; 60/276

[58] Field of Search ..... 204/197; 181/235, 181/244; 60/321, 276, 310; 440/88, 89; 114/55.5, 55.51, 55.57

[56] References Cited

U.S. PATENT DOCUMENTS 3,109,510 11/1963 Phelan ..... 181/244

4,957,461 9/1990 Nakayama ..... 440/89

5,167,934 12/1992 Wolf et al. ..... 440/89

5,212,949 5/1993 Shiozawa ..... 440/89

5,497,724 3/1996 Brown et al. ..... 114/363

5,666,935 9/1997 Kato .

*Primary Examiner*—Ed L. Swinehart

*Attorney, Agent, or Firm*—Knobbe, Martens, Olson & Bear, LLP

[57] ABSTRACT

An improved exhaust probe arrangement within an exhaust system of a small watercraft increases the accuracy of the probe's readings. The aperture is located upstream of a point where cooling water is introduced into the exhaust system for silencing purposes. As a result, the ingress and egress of exhaust gases flow into and out of the aperture is generally unimpeded by the cooling water. The tendency of water to enter and clog the aperture is also reduced. The precision of the exhaust probe measurements consequently is greatly increased.

21 Claims, 6 Drawing Sheets

EXHAUST PROBE ARRANGEMENT FOR SMALL WATERCRAFT ENGINE

BACKGROUND OF THE INVENTION

1. Field of the Invention

The present invention relates to an exhaust system for an engine powering a watercraft. More particularly, the present invention relates to an arrangement for an exhaust probe aperture within an exhaust system for a four-cycle internal combustion engine powering a small watercraft.

2. Description of Related Art

Personal watercraft have become very popular in recent years. This type of watercraft is quite sporting in nature and carries a rider and possibly one or two passengers. A relatively small hull of the personal watercraft commonly defines a riders' area above an engine compartment. An internal combustion engine frequently powers a jet propulsion unit which propels the watercraft. The engine lies within the engine compartment in front of a tunnel formed on the underside of the watercraft hull. The jet propulsion unit is located within the tunnel and is driven by a drive shaft. The drive shaft usually extends between the engine and the jet propulsion device, through a wall of the hull tunnel.

An exhaust system of the personal watercraft discharges engine exhaust to the atmosphere either through or close to the body of water in which the watercraft is operating. Although submerged discharge of engine exhaust silences exhaust noise, environmental concerns arise.

Such environmental concerns have raised a desire to minimize exhaustion of hydrocarbons and other exhaust byproducts (e.g., carbon monoxide and oxides of nitrogen), and thus reduce pollution of the atmosphere and the body of water in which the watercraft is operated. In response to the increased concerns regarding exhaust emissions, some personal watercraft engines recently have become equipped with electronic control units that adjust the fuel/air charge delivered to the engine depending upon the operating condition of the engine. The ECU receives signal data from a variety of engine sensors and then controls engine operation in order to optimize performance, while minimizing hydrocarbon emissions.

An oxygen sensor is one of the main controlling sensors in the control system. The oxygen sensor monitors oxygen content in the exhaust. The amount of oxygen in the exhaust indicates the richness (low oxygen content) or leanness (high oxygen content) of the fuel/air charge. Based upon this information, the ECU alters the concentration of fuel in the air fuel charge to control emissions. The oxygen sensor probe often is located in a probe aperture in which exhaust gases collect for sampling. The pressure pulses or waves within the exhaust system produce a flow of exhaust gas into and out of the aperture for sampling purposes.

Personal watercraft exhaust system commonly mix cooling water into the exhaust flow to reduce the temperature and noise of the exhaust gases exiting the engine. The water introduced into the exhaust system, however, often interferes with the collection of exhaust gases in the exhaust probe aperture. The cooling water also commonly invades the aperture, thereby preventing an influx of exhaust gases. The oxygen sensor consequently provides imprecise measurements of the oxygen content in the exhaust gas flow.

SUMMARY OF THE INVENTION

A need therefore exists for an improved exhaust probe aperture arrangement within an exhaust system of a small watercraft that improves the collection of exhaust gas for sampling, while still allowing for exhaust gas silencing achieved by mixing coolant with the exhaust gas flow.

An aspect of the present invention thus involves an exhaust system for a watercraft. The watercraft comprises a hull containing an internal combustion engine mounted within the hull and having at least one exhaust port. The exhaust system includes an inlet end communicating with at least the one exhaust port of the engine to receive exhaust gases therefrom, and an outlet end exiting through the hull to discharge the exhaust gases to the atmosphere in proximity to the body of water in which the watercraft is operating. An exhaust probe aperture is arranged within the exhaust system to collect exhaust gases flowing through the exhaust system. A coolant jacket extends along a portion of the exhaust system and communicates with the exhaust system at a point downstream of the exhaust probe aperture so as to introduce at least a portion of the coolant flowing through the coolant jacket into the exhaust gases flowing through the exhaust system.

In accordance with another aspect of the present invention, a small watercraft is provided. The small watercraft comprises an internal combustion engine and a hull defining an engine compartment in which the engine is located. The engine has at least one cylinder with at least one exhaust port. An exhaust system extends between the exhaust port on the engine and a discharge port on the hull. An exhaust probe aperture is arranged within the exhaust system to collect a sample of the exhaust gas stream flowing through the exhaust system. A coolant jacket extends along a portion of the exhaust system. The coolant jacket communicates with the exhaust system at a point downstream of the exhaust probe aperture such that at least a portion of the coolant flowing through the coolant jacket is introduced into the exhaust gas stream without interfering with the collection of the exhaust gas sample in the exhaust probe aperture.

Another aspect of the present invention involves an exhaust system for a watercraft comprised of a hull containing an internal combustion engine mounted within the hull. The engine has at least one exhaust port. The exhaust system comprises an inlet end communicating with at least the one exhaust port of the engine to receive exhaust gases therefrom, an outlet end exiting through the hull to discharge the exhaust gases to the atmosphere in proximity to the body of water in which the watercraft. A water trap is located between the inlet and outlet ends. The water trap includes a sacrificial anode to inhibit corrosion within the water trap.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF PREFERRED EMBODIMENT

Figure 1:
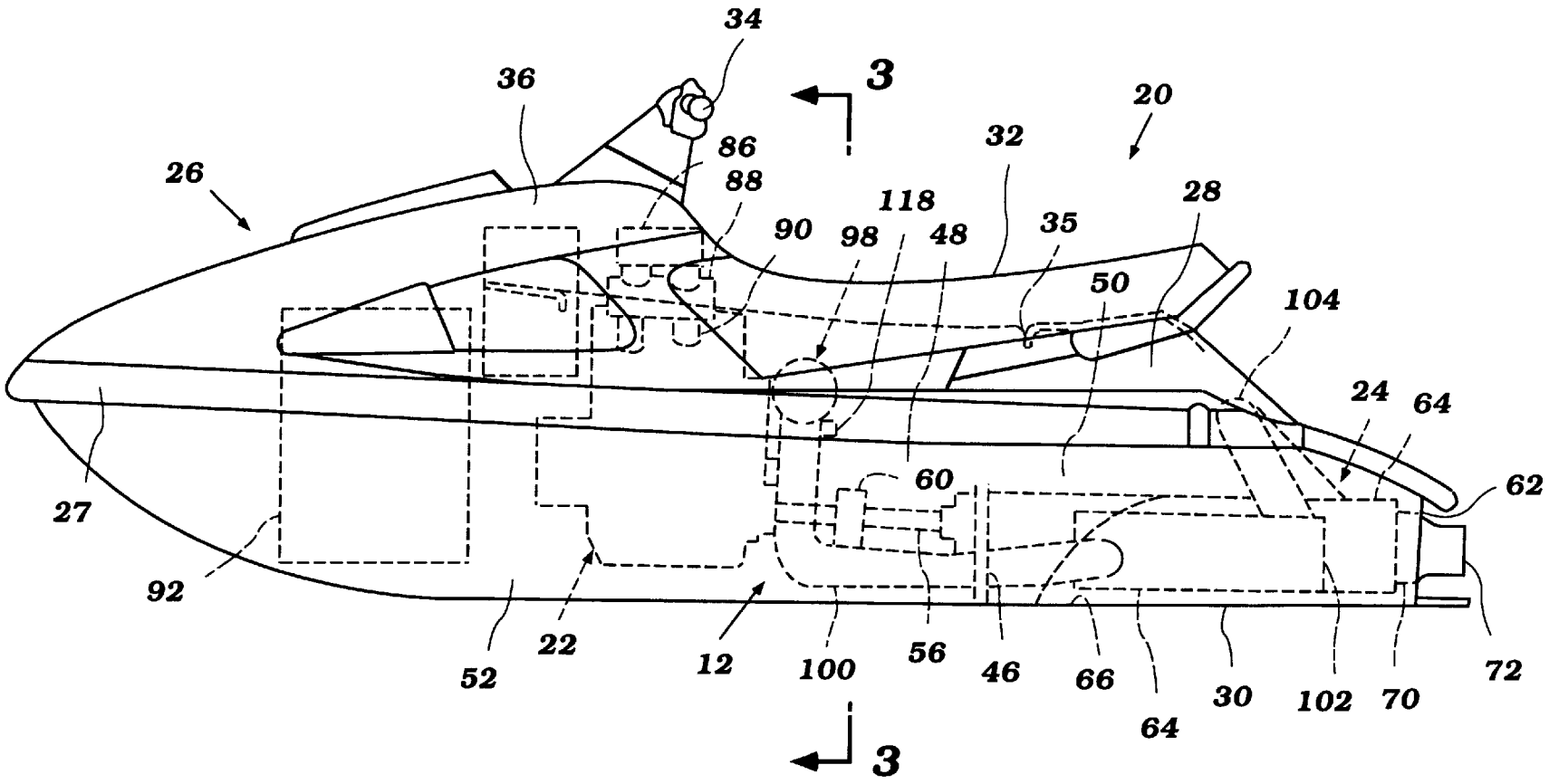
FIG. 1 is a side view, with internal parts illustrated in phantom, of a personal watercraft powered by an engine including an exhaust probe arranged in accordance with a preferred embodiment of the present invention.
Figure 2:
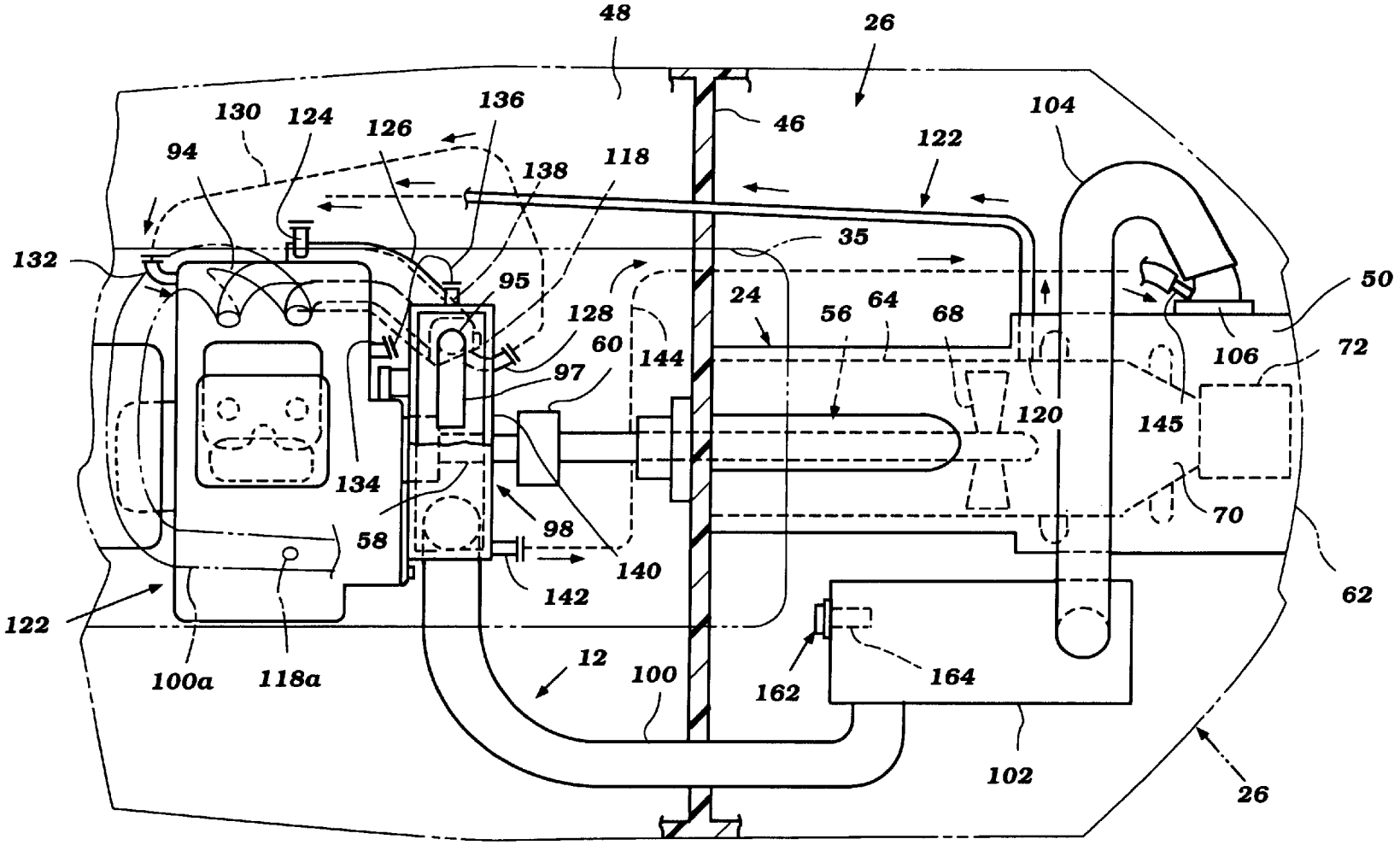
FIG. 2 is a sectional, partial top view of the watercraft of FIG. 1, and illustrates a portion of the engine, an associated exhaust system, and water propulsion unit in a hull of the watercraft, as well as illustrates in phantom another arrangement of an exhaust of the exhaust system.
Figure 3:
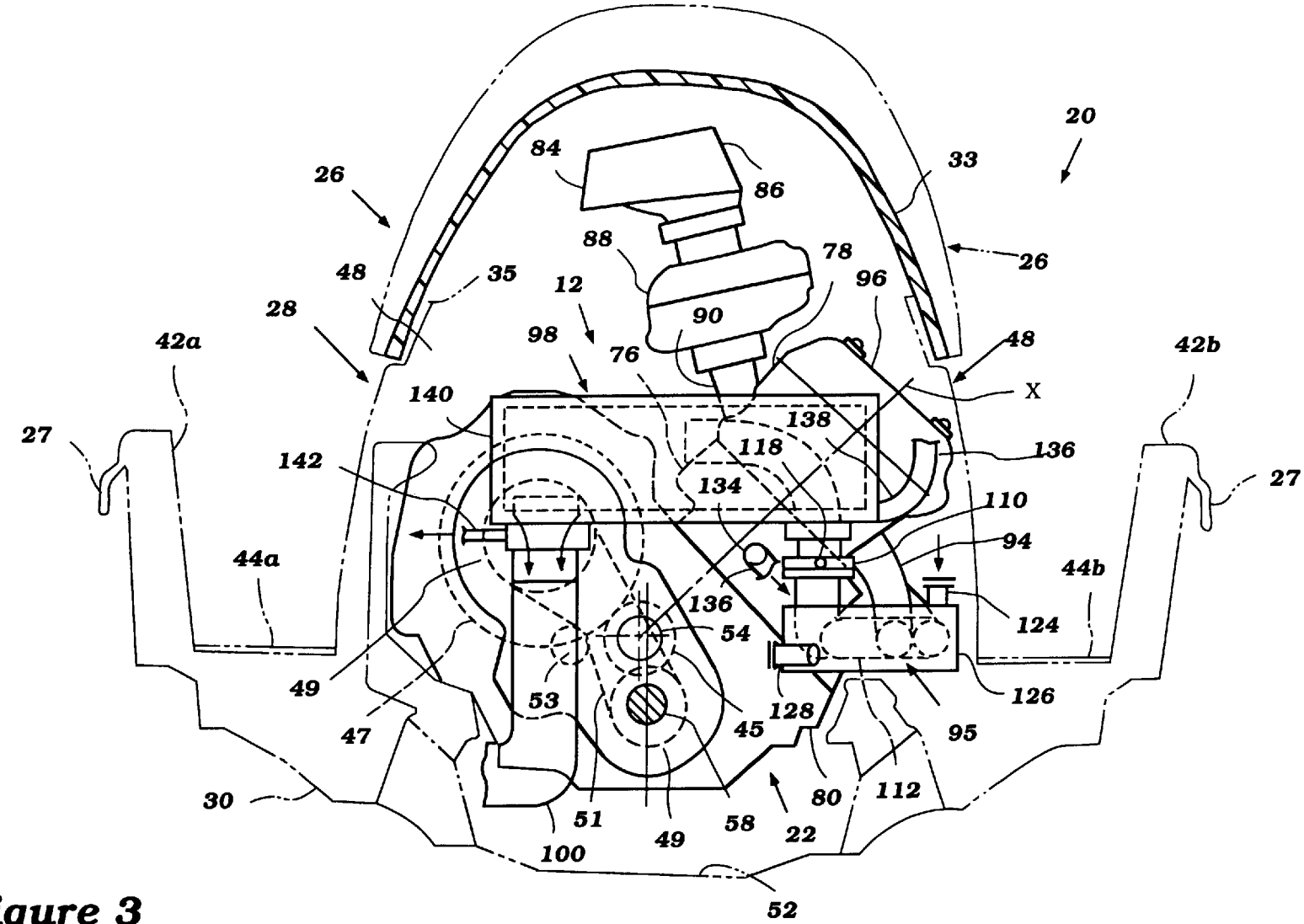
FIG. 3 is a cross-sectional view of the watercraft of FIG. 1 taken along line 3—3, and illustrates a portion of the exhaust system on a rear side of the engine.

FIGS. 1–3 illustrate a personal watercraft 10 the includes an exhaust system 12 configured in accordance with a preferred embodiment of the present invention. Although the present exhaust system 12 is illustrated in connection with a personal watercraft, the exhaust system and exhaust probe arrangement can be used with other types of watercraft as well, such as, for example, but without limitation, small jet boats and the like.

Before describing the exhaust system 12 and exhaust probe arrangement, an exemplary personal watercraft 10 will first be described in general detail to assist the reader's understanding of the environment of use And the operation of the exhaust system 12.

FIG. 1 illustrates a watercraft 20 having a propulsion unit 24 powered by an engine 22 which is cooled with a cooling system. The watercraft 20 has a hull 26 having a top portion or deck 28 and a lower portion 30. A gunnel 27 defines the intersection of the hull 26 and the deck 28.

A seat 32 is positioned on the top portion 28 of the hull 26. The seat 32 is preferably connected to a removable deck member 33 of the upper deck 28 for use in accessing the engine 22. The seat 32 and the deck member 33 together cover an access opening 35 formed in the upper deck 28. The access opening 35 opens into the hull 26 to provide access to the engine 22 therein. A steering handle 34 is provided adjacent the seat 32 for use by a user in directing the watercraft 20. An access hatch 36 is also preferably provided in the deck 28 in front of the steering handle 34.

As best illustrated in FIG. 3, a bulwark 42*a*, 42*b* extends upwardly along each side of the watercraft 20. A foot step area 44*a*, 44*b* is defined between the seat 32 and its adjacent bulwark 42*a,b*.

The top and bottom portions 28, 30 of the hull 26, along with a bulkhead 46 define an engine compartment 48 and a pumping chamber 50. The engine 22 is positioned in the engine compartment 48. The engine 22 is preferably connected to the hull 26 via several engine mounts (not shown) connected to a bottom 52 of the lower portion 30 of the hull 26.

As understood from FIGS. 1 and 3, the engine 22 has a crankshaft 54 which is in driving relation with an impeller shaft 56 via an output shaft 58. In particular, the crankshaft 54 drives the output shaft 58, which extends outwardly from the rear end of the engine 22. The output shaft 58 is removably coupled to the impeller shaft 56 via a coupling member 60.

A transmission operates between the crankshaft 54 and the output shaft 58. The transmission includes a drive gear 45 attached to the crankshaft 54 and a larger, driven idler gear 47 mounted above and to a side of the crankshaft 54. The idler gear 47 in turn drives a intermediate gear sprocket or pulley 49. A drive belt or chain 51 couples the intermediate sprocket or pulley 49 to a driven sprocket or pulley 49 attached to the output shaft 58. A tensioner 53 is used to tighten the belt or chain 51, as known in the art. The power transfer train of the transmission desirably is configured to reduce or step down the rotational speed, such that the output shaft 58 rotates at a slower speed than the crankshaft 54 in order to match the maximum rotational speed of the output shaft 58 to the rotational speed limits of the propulsion device 24.

The impeller shaft 56 rotationally drives an impeller 68 of the propulsion unit 24. The propulsion unit 24 includes an intake duct 64 having an intake port 66 which extends through the lower portion 30 of the hull 26. The impeller 68 is positioned within a pump housing that communicates with a pressure chamber and a nozzle 70. A steering nozzle 72 is mounted for movement to the left and right for steering purposes.

The engine 22 is best illustrated in FIGS. 2 and 3. As illustrated therein, the engine 22 is preferably of the two-cylinder, four-cycle variety. Of course, the engine 22 may have as few as one, or more than two, cylinders, as may be appreciated by one skilled in the art. The cylinders are inclined relative to vertical along an incline axis X. This arrangement reduces the height of the engine 22, while increasing the engine displacement.

The engine 22 includes a cylinder block 76 having a cylinder head 78 connected thereto and cooperating therewith to define two combustion chambers (not shown). A piston is movably mounted in each cylinder, and connected to the crankshaft 54 via a connecting rod, as is well known to those skilled in the art.

The crankshaft 54 is rotatably journalled with respect to the cylinder block 76 within a crankcase 80 portion of the engine 22. Preferably, the chamber 80 is defined by a crankcase cover member which extends from a bottom portion of the cylinder block 76.

The engine 22 includes means for providing an air and fuel mixture to each combustion chamber. Preferably, air is drawn into the engine compartment 48 through at least one air inlet into the hull 26. Air is then drawn through an intake 84 of air box or silencer 86. The air drawn into the silencer 86 passes into an air intake passage leading through an intake manifold 90 corresponding to each combustion chamber (i.e., in this case, there are two of such passages). Preferably, the flow of air into each combustion chamber is regulated by at least one camshaft operated intake valve (not shown), as is well known to those skilled in the art.

Preferably, fuel is provided to each combustion chamber by a carburetor 88 positioned along each intake passage (i.e. there are two carburetors 88 in this embodiment) between the silencer 86 and the intake manifold 90. The carburetor 88 is preferably linked to an operator control at the steering handle 34 for use by the operator in controlling the speed of the engine 22. Fuel is supplied by a fuel pump (not shown) from a fuel tank 92 positioned in the engine compartment 48. Of course, as one skilled in the art may appreciate, fuel may be supplied to the engine 22 with direct or indirect fuel injection instead of via carburation.

A suitable ignition system is provided for igniting the air and fuel mixture provided to each combustion chamber. Preferably, this system comprises a spark plug (not shown) corresponding to each combustion chamber. The spark plugs are preferably fired by a suitable ignition system, which preferably includes an electronic control.

Exhaust gas generated by the engine 22 is routed from the engine to a point external to the watercraft 20 by an exhaust system, which is described in detail below. Exhaust from each combustion chamber is preferably expelled from the combustion chamber to passages extending through an exhaust manifold 94 through one or more exhaust passages in the cylinder head 78 (not shown). Means are provided for controlling the flow of exhaust gases through these exhaust passages. Preferably, this means comprises an exhaust valve. Each exhaust valve is actuated by a common exhaust camshaft.

The intake and exhaust camshafts are mounted for rotation with respect to the cylinder head 78. The camshafts are positioned within a camshaft chamber formed by a camshaft cover 96 connected to the cylinder head 78. Means are provided for rotating the camshafts to effectuate movement of the intake and exhaust valves. Preferably, this means comprises a timing belt (not shown) which extends about a camshaft sprocket positioned on an end of each camshaft and a drive pulley mounted on the crankshaft 54.

In the exhaust manifold 94 of the exhaust system, exhaust passing into the passages in the upper exhaust manifold 94 is routed into a merge pipe 95, where the exhaust gas flowing through each passage in the exhaust manifold 94 are combined. The combined exhaust then flows out an end 97 of the merge pipe 95 into an exhaust expansion chamber 98 formed at an upper end of the merge pipe 95. The expansion chamber 98 serves primarily as an exhaust silencer. The exhaust is then routed from the chamber 98 through a flexible pipe 100 to a water trap 102, which will be described in detail below. An exhaust pipe 104 extends from an outlet section of the water trap 102 and wraps over the top of the pumping chamber 50 to a discharge end 106. The discharge end desirably is located near the stern 62 of the watercraft 10, but opens into the pumping chamber 50 at an area that is close to or actually below the water lever with the watercraft 10 floating at rest on the body of water.

Figure 4:
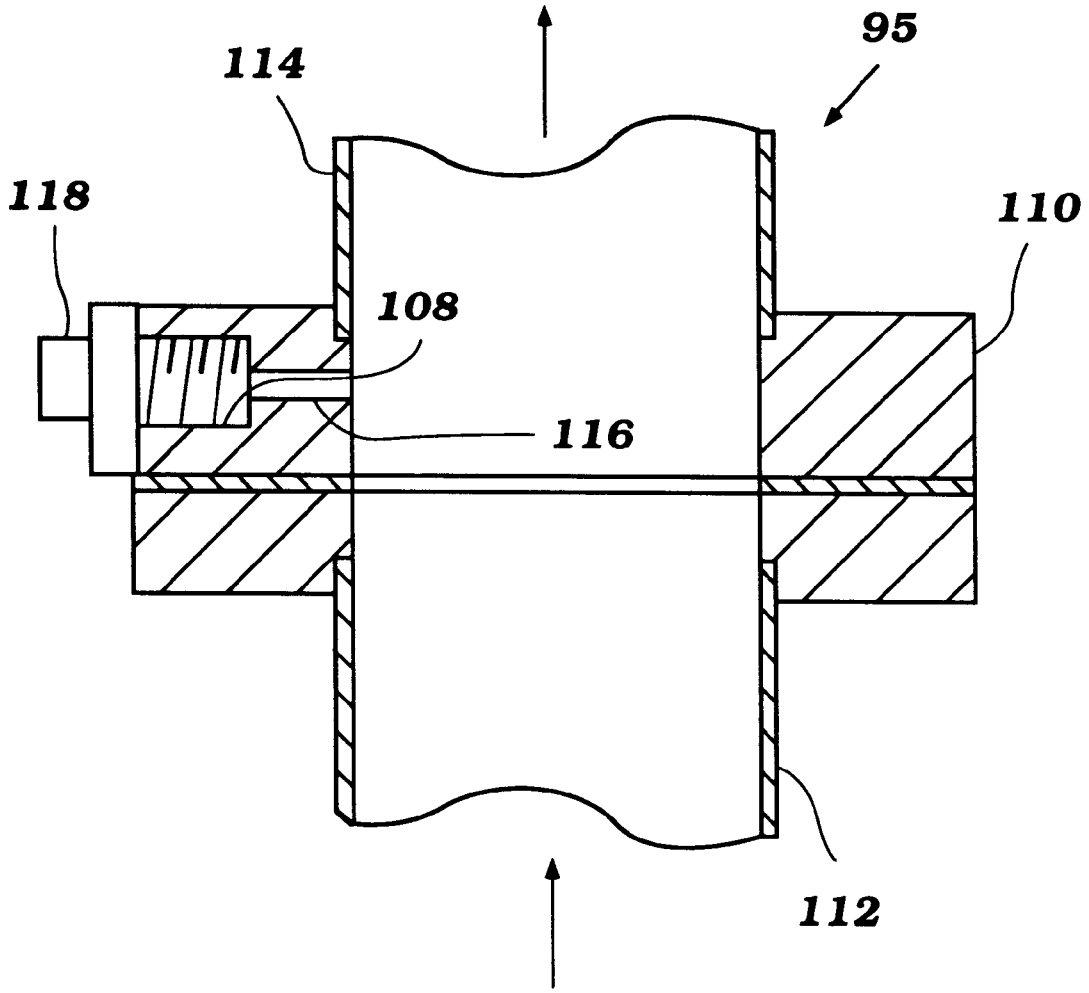
FIG. 4 is an enlarged, cross-sectional view of a portion of the exhaust system of FIG. 3.

As best seen in FIG. 4, an exhaust probe aperture 108 is formed within the merge pipe 95 downstream of the point where the exhaust passages merge. In the illustrated embodiment, the exhaust probe aperture 108 is formed in a flange 110 that joins together upstream and downstream sections 112, 114 of the merge pipe 95. A small orifice 116 connects the aperture 108 to the exhaust flow path through the flange 110. An exhaust probe 118 (e.g., an oxygen sensor) is attached to the flange 110 and communicates with the aperture 108 to sense one or more characteristics of the exhaust gas sample collected within the aperture 108. In this position, the exhaust probe 118 lies upstream of the expansion chamber 98; however, other location of the probe 118 within the exhaust system also are possible, while generally isolating the aperture 108 from a coolant flow within the exhaust system, as described below.

As one aspect of this exhaust probe 118 arrangement, the aperture 108 is adapted to receive an exhaust gas sensor of the type utilized to thoroughly sample and analyze the exhaust gas content. If, for example, the engine 22 of the watercraft is running rough, the owner of the craft may wish a mechanic to inspect and tune the engine. The mechanic may remove the probe 118 from the aperture 108 and insert in its place an exhaust gas sensor plug, obtain a sample of the exhaust gas for analysis, and then reinstall the probe 118 for use during normal operating conditions.

As schematically illustrated in FIG. 2, the exhaust system can also have other configurations while still achieving the advantages of the present invention. An exhaust pipe 100*a* can communicate directly with the exhaust manifold 94 and the exhaust probe 118*a* can be positioned within the exhaust pipe 100*a*.

As best understood from FIG. 2, the engine 22 includes a liquid cooling system. Cooling water is drawn through an intake 120 from the high pressure area within the pressurization chamber of the propulsion device 24. Coolant passes from the intake 120 through a main supply pipe 122 to a cooling water inlet port 124 of an exhaust manifold cooling jacket 126. This cooling jacket 126 surrounds at least a portion of the exhaust manifold 94 and the merge pipe 95 for cooling the exhaust gases flowing therethrough.

Coolant in the jacket 126 exits through a drain 128 into a first coolant hose 130 which leads to a cylinder head coolant inlet 132. The coolant is circulated through one or more coolant passages within the cylinder head 78 for cooling the exhaust gases passing through the exhaust passages therein and the portion of the combustion chambers formed therein. The coolant is then routed, preferably internally, to one or more coolant passages in the cylinder block 76.

After passing through the cylinder block 76, the coolant flows through a cylinder block coolant drain 134 to a second coolant hose 136 leading to an inlet 138 of an exhaust chamber coolant jacket 140. The exhaust chamber coolant jacket 140 surrounds at least a portion of the expansion chamber 98 for cooling the exhaust gases therein.

Preferably a portion of the coolant passes through an outlet extending in communication with the jacket 140 of the exhaust chamber 98 into the exhaust gases as they flow therefrom into the flexible exhaust pipe 100. The remainder of the coolant exits the jacket 140 through a drain 142 leading to a third hose or return line 144 leading to a discharge port 145 at the discharge end 106 of the exhaust system.

The presence of water within the exhaust system downstream of the expansion chamber 98, while advantageous for cooling and silencing purposes, can create several problems. One problem is the back flow of water to the engine 22. Because of the sporting nature of personal watercraft 20, such crafts are occasionally partially or completely inverted in the water. Under these condition and during the subsequent attempts to right the watercraft, water within the exhaust system can flow toward the engine 22. The water trap 102 is designed to inhibit this back flow.

Figure 5:
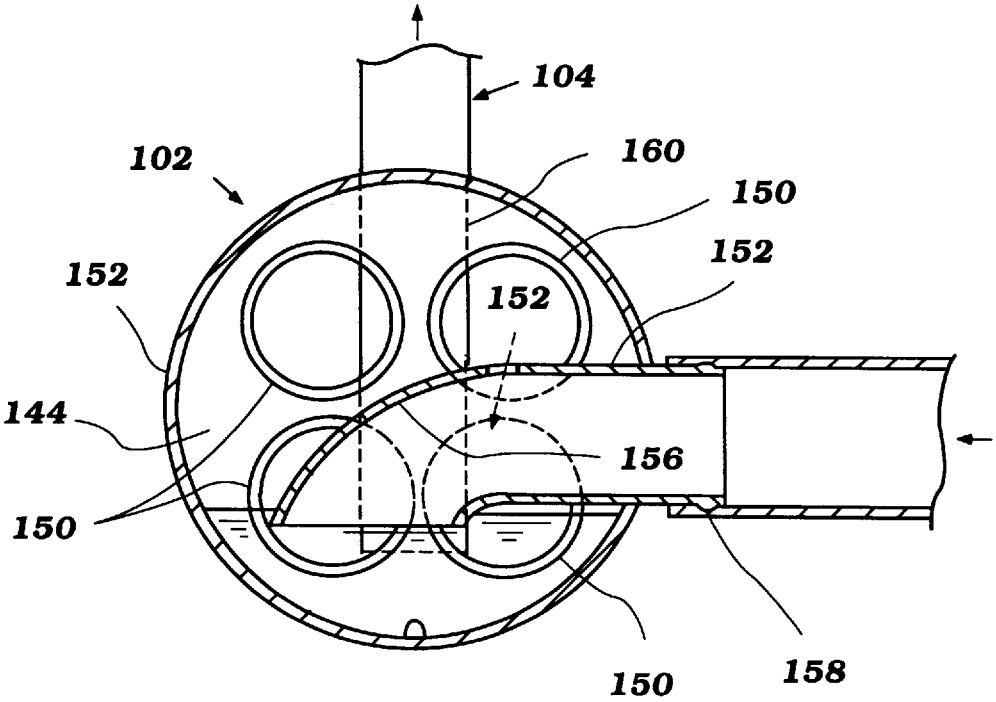
FIG. 5 is an enlarged, cross-sectional view of a water trap device of the exhaust system of FIG. 2.
Figure 6:
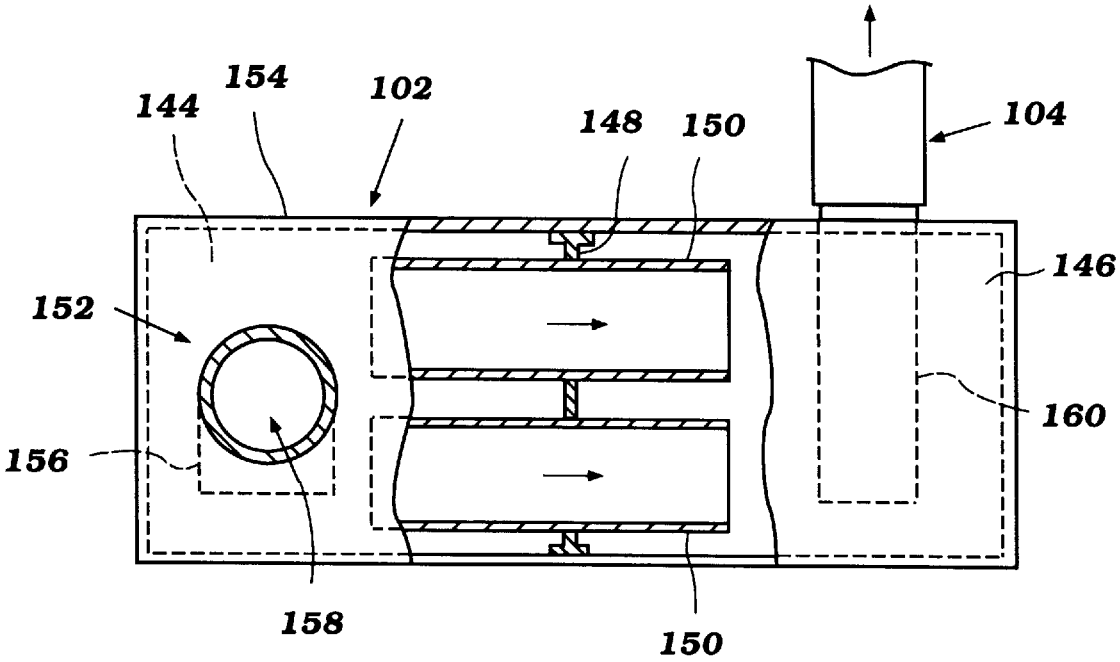
FIG. 6 is a partial sectional, side view of the water trap device of the exhaust system of FIG. 2.

As best seen in FIGS. 5 and 6, the water trap 102 in the illustrated embodiment, has a drum-like structure which is divided into two chambers 144, 146 by a central wall 148. A plurality of elongated tubes 150 extend through the wall 148 and between approximately a mid point of a first chamber 144 to approximately a mid point of a second chaber 146.

An inlet tube 152 extends through a side of a wall 154 of the water trap 102 and opens into the first chamber 144. The inlet tube is arranged to lie generally perpendicular to the internal tubes 150. An end 156 of the inlet tube 152 within the first chamber 144 is turn downward. The outer end 158 of the tube is adapted to connect to the flexible tube 100 of the exhaust system described above.

An outlet tube 160 extends through the top of the water trap wall 154 with its lower end positioned within the second chamber 146. The outlet tube 154 is arranged to be generally perpendicular to the internal tubes 150, as well as to the inlet tube 152. The lower end of the outlet tube 154 lies generally at the same level as the downwardly turned end 156 of the inlet pipe 152.

The resulting labyrinth or tortured path through the water trap 102 inhibits the back flow of water through the exhaust system during abrupt movements of the watercraft and when the watercraft is partially or completely inverted. The water trap 102 also desirably has a sufficient volume to retain and to inhibit the back flow of water to the expansion chamber 98 and the engine 22. The changes in flow capacity between the tubes 152, 150, 160 and the chambers 144, 146 also acts to further silence the exhaust gas flow through the exhaust system.

The water within the water trap 102, however, can corrode the water trap 102, especially in salt water. Typically the corrosion of metals in sea water and other aqueous environments is an electrochemical process, wherein a flow of electrons takes place between certain area of the metal surface in contact with the aqueous solution which is capable of conducting electric current. The result of this electrochemical process is the deterioration of the metal in those area which are commonly referred to as anodes (where electrons leave the metal). Metal ions enter the solution and the metal corrodes. The area receiving the electrons and becoming more negative is termed the cathode. Electrons are discharged to the solution at the cathode. The cathode and the anode may comprise different metals or different areas on the same piece of metal due to impurities on the surface, differences in surface structure, etc.

In order to inhibit such corrosion of the water trap 102, the water trap desirably includes a sacrificial anode 162. The material of an electrode 164 of the sacrificial anode 162 is selected to deteriorate before the metal of the water trap 102 deteriorates. That is, the anode material is selected to have a higher oxidation potential than the metal(s) used to form the water trap 102.

Figure 7:
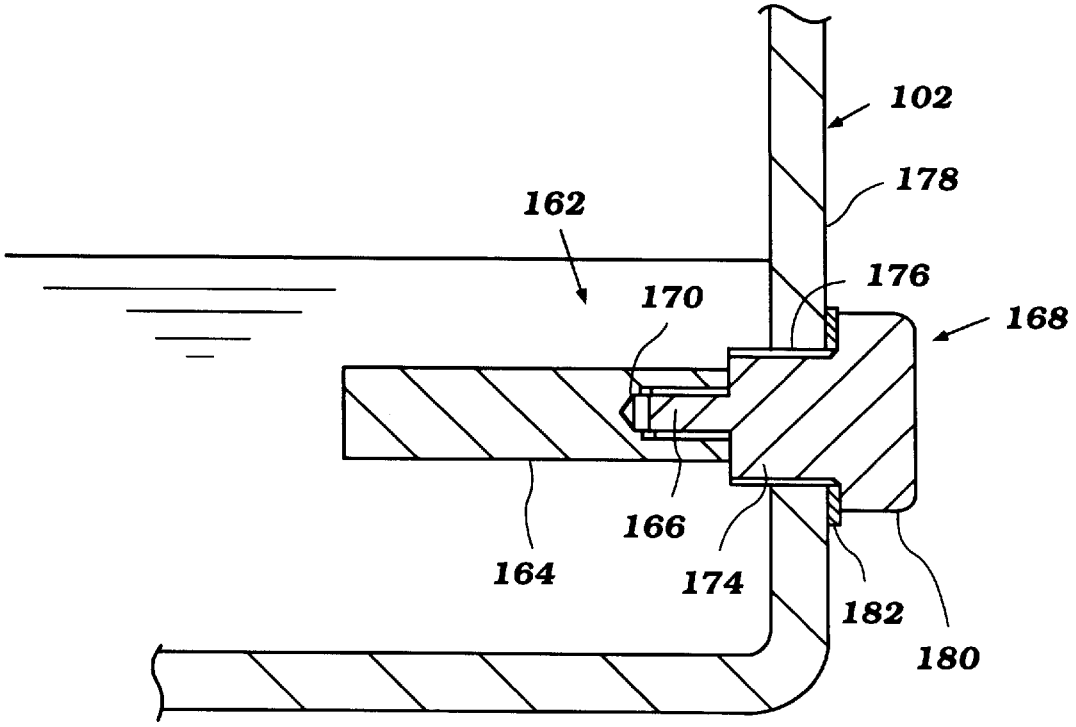
FIG. 7 is an enlarged sectional view of a portion of the water trap device and illustrates a sacrificial anode of the water trap device.
Figure 8:
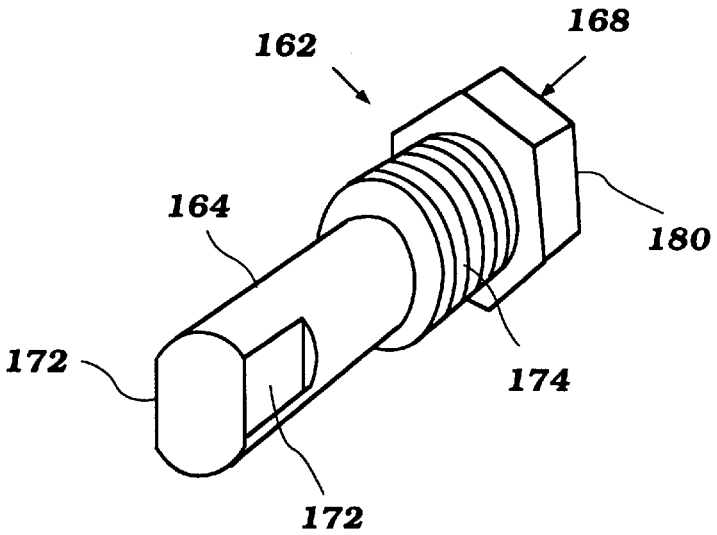
FIG. 8 is an enlarged perspective view of the sacrificial anode of FIG. 7.

As seen in FIGS. 7 and 8, the sacrificial anode includes the electrode 164 attached to a shank 166 of a bolt 168. In the illustrated embodiment, the anode electrode 164 includes a threaded hole 170 that receives the externally threaded shank 166 of the bolt 168. A pair of gripping flats 172 are formed on the tip of the anode electrode 164 to allow rotation of the bolt 168 relative to the electrode 164 for this purpose.

The bolt 168 also includes a threaded shoulder 174. The external threads on the shoulder 174 correspond to internal threads formed within a mounting hole 176 on an end wall 178 of the water trap 102. In the illustrated embodiment, the mounting hole 176 opens into the first chamber 144 near the downwardly turned end 156 of the inlet tube 152 and near a lower side of the side wall 154. Other locations of the sacrificial anode 162 within the water trap 102, however, are also possible. The bolt 168 is threaded into the mounting hole 176 with a sealing washer 180 interposed between a head 182 of the bolt 168 and the end wall 178 so as to seal the mounting hole 176 with the bolt 168 fully inserted. In this position, the anode electrode 164 extends into the first chamber 144 at a level that lies within the water when a normal amount of water occupies the water trap 102.

The sacrificial anode 102 is easily replaced by removing the bolt 168 from the hole 176 and then detaching the electrode 164 from the bolt 168. As appreciated from FIG. 1, the front end 178 of the water trap 102 is accessible through the access opening 35 in the upper deck 28.

A control system desirably manages the operation of the engine 22. The control system includes an electronic control unit (ECU) that receives signals from various sensors regarding a variety of engine functions. As part of a feedback control system, the ECU receives signals from the oxygen sensor 118 mounted in the collection aperture 108. The aperture 108 communicates with the merge pipe 95 and continuously receives exhaust gases as the exhaust passes through to the expansion chamber 98. Pressure waves or pulses within the merge pipe 95 tend to force exhaust gases into and draw exhaust gases from the collection aperture 108 so as to provide fresh samples of the exhaust gases for continuous monitoring of the oxygen content of the exhaust.

The oxygen sensor 118 produces and sends a signal to the ECU which is indicative of the oxygen content in the exhaust gases. Based upon this information, the ECU adjusts the fuel/air ratio, as known in the art.

The position of the exhaust probe aperture 108 well upstream of the point where a portion of the cooling water is introduced into the exhaust system generaly isolates the collection process from the effects of the water flow through the exhaust system. While some coolant may travel backwardly through the exhaust system towards the probe aperture 108 on occasion, such as by force of strong exhaust gas pulses, no meaningful amount of liquid water is present within the exhaust steam at the point of sampling, and thus, the gases can flow freely through the orifice 116 without impedance from entrained liquid in the flow. In addition, liquid water tends not to clog or contaminate the aperture 108 or sensor 118 in the present system. The oxygen sensor therefore more accurately senses the of the oxygen content within the exhaust stream for improved engine control.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. An exhaust system for a watercraft comprised of a hull including an elongated central seat with a pair of foot wells extending along side the central seat, the hull containing an internal combustion engine mounted within the hull and having at least one exhaust port, said exhaust system comprising an inlet end communicating with at least the one exhaust port of the engine to receive exhaust gases therefrom, an outlet end exiting through the hull to discharge the exhaust gases, a water trap arranged between the inlet end and the outlet end, an exhaust probe aperture arranged within the exhaust system upstream of the water trap, and a coolant jacket extending along a portion of the exhaust system, the coolant jacket communicating with the exhaust system at a point downstream of the exhaust probe aperture so as to introduce at least a portion of the coolant flowing through the coolant jacket into the exhaust gases flowing through the exhaust system.

2. An exhaust system as in claim 1, wherein said exhaust system includes an exhaust manifold with a plurality of runner passages that are adapted to communicates with a plurality of exhaust ports of the engine, the runner passages being arranged to merge together into a common passage, and the exhaust probe aperture lies within the common passage.

3. An exhaust system as in claim 2, wherein said runner passages merge together at a merger area, and the exhaust probe aperture is arranged downstream of the merger area.

4. An exhaust system as in claim 3, wherein said merger area is formed in a merge pipe section of the exhaust system.

5. An exhaust system as in claim 4, wherein said cooling jacket juxtaposes at least a portion of said merge pipe section.

6. A small watercraft as in claim 1, wherein the exhaust probe aperture is sufficiently sized so as to collect a volume of exhaust gases with an exhaust sensor inserted into the exhaust probe aperture.

7. A small watercraft as in claim 1, wherein the hull includes an access opening formed above the engine, and the exhaust probe aperture is arranged beneath the access opening.

8. A small watercraft comprising an internal combustion engine, a hull defining an engine compartment in which the engine is located, the hull including an elongated central seat with a pair of foot wells extending along side the central seat, the engine having at least one cylinder with at least one exhaust port, and an exhaust system extending between the exhaust port on the engine and a discharge port on the hull, the exhaust system including a water trap and an exhaust probe aperture arranged within the exhaust system upstream of the water trap, and a coolant jacket extending along a portion of the exhaust system, the coolant jacket communicating with the exhaust system at a point downstream of the exhaust probe aperture, whereby at least a portion of the coolant flowing through the coolant jacket is introduced into the exhaust gas stream without interfering with the collection of the exhaust gas sample in the exhaust probe aperture.

9. A small watercraft as in claim 8, wherein the hull includes an access opening formed above the engine, and the exhaust probe aperture is arranged beneath the access opening.

10. A small watercraft as in claim 8, wherein the exhaust system additionally comprises an exhaust manifold configured to merge exhaust gas flows from a plurality of cylinders of the engine, and the exhaust probe aperture is located downstream of the exhaust manifold.

11. A small watercraft as in claim 10, wherein said coolant jacket extends along at least a portion of the exhaust manifold.

12. A small watercraft as in claim 8, wherein the water trap including a sacrificial anode.

13. A small watercraft as in claim 12, wherein said sacrificial anode is removably attached to the water trap.

14. A small watercraft as in claim 8, wherein said engine is a four-cycle engine.

15. A small watercraft as in claim 14 additionally comprising a propulsion device carried by the hull and driven by the engine, and said hull defining a rider's area sized to accommodate at least one rider.

16. A small watercraft as in claim 8, wherein the exhaust probe aperture is sufficiently sized so as to collect a volume of exhaust gases with an exhaust sensor of an exhaust probe inserted into the exhaust probe aperture.

17. An exhaust system for a watercraft comprised of a hull containing an internal combustion engine mounted within the hull and having at least one exhaust port, said exhaust system comprising an inlet end communicating with at least the one exhaust port of the engine to receive exhaust gases therefrom, an outlet end exiting through the hull to discharge the exhaust gases, and a water trap located between the inlet and outlet ends, the water trap including a sacrificial anode.

18. An exhaust system as in claim 17, wherein said sacrificial anode is removably attached to the water trap and is arranged within an internal chamber within the water trap.

19. An exhaust system as in claim 18, wherein the sacrificial anode is removably attached to a bolt that threadingly engages and plugs a threaded hold in a wall of the water trap.

20. An exhaust system as in claim 17 additionally comprising an exhaust probe aperture arranged upstream of the water trap within the exhaust system to collect exhaust gases flowing through the exhaust system.

21. An exhaust system as in claim 20 additionally comprising a coolant jacket extending along a portion of the exhaust system, the coolant jacket communicating with the exhaust systemn at a point downstream of the exhaust probe aperture.

* * * * *